US009669989B2

(12) United States Patent
Sanders

(10) Patent No.: US 9,669,989 B2
(45) Date of Patent: Jun. 6, 2017

(54) COMBINATION MEDICINE CONTAINERS AND DISPENSERS

(71) Applicant: Donald T. Sanders, Indianapolis, IN (US)

(72) Inventor: Donald T. Sanders, Indianapolis, IN (US)

( * ) Notice: Subject to any disclaimer, the term of this patent is extended or adjusted under 35 U.S.C. 154(b) by 0 days.

(21) Appl. No.: 14/335,677

(22) Filed: Jul. 18, 2014

(65) Prior Publication Data

US 2015/0021349 A1 Jan. 22, 2015

Related U.S. Application Data

(60) Provisional application No. 61/847,728, filed on Jul. 18, 2013.

(51) Int. Cl.

| | |
|---|---|
| ***B65D 83/04*** | (2006.01) |
| ***A61J 1/03*** | (2006.01) |
| *A61J 1/14* | (2006.01) |

(52) U.S. Cl.
CPC ..... *B65D 83/0409* (2013.01); *A61J 1/03* (2013.01); *A61J 1/1418* (2015.05)

(58) Field of Classification Search
CPC ..... A61J 1/03; A61J 1/1412; A61J 7/0084; B65D 25/04; B65D 83/04; B65D 83/0409
See application file for complete search history.

(56) References Cited

U.S. PATENT DOCUMENTS

| | | | | | |
|---|---|---|---|---|---|
| 2,729,366 | A | * | 1/1956 | Chadwick | 222/362 |
| 3,313,441 | A | * | 4/1967 | Fadden | 215/206 |
| 3,730,387 | A | * | 5/1973 | McConnell et al. | 221/265 |
| 3,860,111 | A | * | 1/1975 | Thompson | 206/534 |
| 3,885,703 | A | * | 5/1975 | Neavin | 221/202 |
| 3,926,335 | A | | 12/1975 | Dangles et al. | |
| 4,337,876 | A | * | 7/1982 | Thompson | A47K 10/3818 221/36 |
| 4,460,106 | A | * | 7/1984 | Moulding et al. | 221/1 |
| 4,613,057 | A | * | 9/1986 | Sacchetti et al. | 221/265 |
| 4,653,668 | A | | 3/1987 | Gibilisco et al. | |
| 4,782,980 | A | * | 11/1988 | Heimlich et al. | 221/265 |
| 4,939,705 | A | * | 7/1990 | Hamilton et al. | 368/10 |
| 5,322,166 | A | | 6/1994 | Crowther | |
| 5,662,239 | A | * | 9/1997 | Heuvelman | 220/506 |
| 5,791,515 | A | * | 8/1998 | Khan et al. | 221/154 |
| 5,947,329 | A | * | 9/1999 | Bailey | 221/288 |
| 6,299,019 | B1 | * | 10/2001 | Leight | 221/186 |

(Continued)

*Primary Examiner* — Gerald McClain
*Assistant Examiner* — Kelvin L Randall, Jr.
(74) *Attorney, Agent, or Firm* — Bruce J. Bowman

(57) ABSTRACT

Combination medicine containers and dispensers are shaped similar to or generally the same as standard prescription medicament containers but are configured to dispense one medicament at a time through easy manipulation of integral dispensing means. Each combination medicine container and dispenser has a bottle, a cap, and an integral dispensing mechanism that cooperate with one or more structures of the bottle and/or cap to dispense one medicament at a time from the container. In one form, the combination medicine container and dispenser is designed to allow a user to dispense a single medicament through properly applied pressure. In another form, rotation of one or more components provides dispensing of a single medicament.

6 Claims, 20 Drawing Sheets

(56) References Cited

U.S. PATENT DOCUMENTS

| | | | | |
|---|---|---|---|---|
| 6,302,295 | B1 * | 10/2001 | Weisman | 221/188 |
| 7,097,068 | B2 * | 8/2006 | Limback et al. | 221/2 |
| 2004/0154955 | A1 * | 8/2004 | Friar et al. | 206/533 |
| 2007/0007301 | A1 * | 1/2007 | Kaplan et al. | 221/288 |
| 2012/0006700 | A1 | 1/2012 | Geboers et al. | |
| 2013/0153608 | A1 * | 6/2013 | Amin et al. | 222/448 |
| 2013/0200033 | A1 * | 8/2013 | Zonana et al. | 215/231 |
| 2013/0248551 | A1 * | 9/2013 | Tignanelli et al. | 221/15 |

* cited by examiner

COMBINATION MEDICINE CONTAINERS AND DISPENSERS

CROSS-REFERENCE TO RELATED APPLICATIONS

This non-provisional patent application claims the benefit of and/or priority under 35 U.S.C. §119 to U.S. Provisional Patent Application Ser. No. 61/847,728 filed Jul. 18, 2013, entitled "Combination Medicine Container and Dispenser" the entire contents of which is specifically incorporated herein by this reference.

FIELD OF THE INVENTION

The present invention relates to containers for holding medicine in the form of pills, tablets, capsules and the like and, more particularly, to medicine containers for holding pills, tablets, capsules and the like that incorporate medicine dispensing means.

BACKGROUND

The typical packaging for selling medicines, medicaments and/or prescriptions in the form of pills, tablets, capsules or the like (collectively, and hereinafter, "pill"), especially those used by a pharmacy, is an open-ended plastic cylindrical bottle or container with a separate cap for closing the opening. The cap is securable to the bottle via various attachment methods such as screw threads, interference or snap fit structures, as well as child-proof structures and the like. However, no matter what the style, the cap needs to be removed in order to retrieve or dispense the contents.

In recognition of this problem, U.S. Pat. No. 6,302,295 B1 to Weisman provides a replacement cap for a prescription pill container that allows dispensing of a single pill or capsule without removing the replacement cap. The replacement cap has a transparent hollow storage compartment at its top. The cap has a base that is configured to be received on a typical, child-proof configured top of the prescription pill container. The base includes an opening that is in communication with the interior of the pill container. The transparent lid forming the transparent hollow storage compartment is rotationally disposed on the base and includes an opening that can be selectively positioned over the base opening so as to allow a daily dosage (i.e. a single pill, tablet or capsule) to fall into the transparent lid. The lid may be further rotated to deregister the lid opening from the base opening thereby closing off the container compartment from the lid compartment. A second opening in the side of the transparent lid allows for dispensing the pill or capsule captured in the lid compartment from the lid. However, while the Weisman structure allows for the dispensing of a single pill, it has various shortcomings and/or drawbacks. For instance, the original cap to the prescription container must be replaced, which may be difficult or cumbersome to do. Moreover, in order to dispense a pill or capsule, the container must be turned upside down and shaken or otherwise manipulated in order to have a pill or capsule fall through the cap opening into the lid compartment, and then further manipulated to dispense the pill from the lid compartment through the lid opening.

Various other known pill dispensing containers have complex or complicated dispensing mechanisms for dispensing a single pill. For instance, in U.S. Patent Publication No. 2012/0006700 A1 by Geboers et al., there is provided a pill dispenser having a reservoir with a plurality of compartments, and a positioning disc having a plurality of exit orifices that is configured to dispense pills from the dispenser reservoir in a unit dose manner. This is accomplished by a guiding member that is rotatably arranged between the reservoir and the positioning disc, respectively connecting one compartment with one dedicated exit orifice in dispensing communication by accomplishing a rotary/rotational step.

Another example is U.S. Pat. No. 4,653,668 to Gibilisco et al., where a pill dispensing container that dispenses one pill at a time via a delivery mechanism having a funnel-shaped exit port and a delivery tube at the end of the exit port that is designed to accommodate no more than one pill. The funnel divides the outer receptacle into an upper storage compartment and a lower delivery compartment. A resilient gate member positioned between the exit port and the delivery tube prevents egress of a pill from the delivery tube without actuation of the container. Actuation of the container by pressing and twisting the end of the container allows a pill held by the gate member to be released thereby dispensing the pill from the container.

Other pill dispensing containers provide a plurality of individual compartments for holding a pill and a cover or housing that is configured to individually dispensing a pill. Examples of this type include U.S. Pat. No. 3,926,335 to Dangles et al. and U.S. Pat. No. 5,322,166 to Crowther. These devices however, like the above referenced devices, are cumbersome to use, generally inefficient and hard to manipulate by the typical medication user.

As discerned from the above, what is therefore needed is a less complicated pill dispensing container. What is further needed is a medicine dispensing container that is easy to manipulate in order to singularly dispense a pill. What is furthermore needed is a medicine dispensing container that is similar to existing pharmaceutical medicine dispensing containers. What is moreover needed is a medicine dispensing container that is simple in construction and manufacture. These and other needs are addressed by the present invention.

SUMMARY OF THE INVENTION

Disclosed herein are combination medicine containers and dispensers each one being shaped similar to or generally the same as a standard prescription medicament container but which are configured to dispense one medicament at a time through easy manipulation of its dispensing means.

Each combination medicine container and dispenser has a bottle, a cap, and dispensing means that cooperate with one or more structures of the bottle and/or cap to dispense one medicament at a time from the container. Each bottle has a shape that is similar to or the same as typical cylindrical prescription medicine containers.

In one form, the combination medicine container and dispenser is designed to allow a user to dispense a single medicament through properly applied pressure. Such pressure elastically deforms portions of the container/dispenser to allow a single medicament to be dispensed.

In an illustrative embodiment of the elastic form of the present combination medicine container and dispenser, the elastic combination medicine container and dispenser has a bottle defining an upper generally cylindrical portion and a lower generally cylindrical portion having a flat side, the upper portion sized so as to extend beyond the flat side of the lower portion, thereby defining a ledge within the interior of the upper and lower portions. The rim of the upper portion has a cutout disposed generally opposite the ledge. A generally cylindrical cap, having a window in a side thereof, is configured for reception on the upper portion of the bottle, wherein the window is adjacent the cutout of the upper portion. This allows a medicament to be dispensed from the upper area of the upper portion. An elastic disk-shaped divider is provided within the bottle over the ledge which serves to divide the bottle into a lower area that is within the lower portion of the bottle, and an upper area that is within the upper portion of the bottle. The divider has a cutout that normally lies over the ledge such that there is no communication between the lower area and the upper area. Pressure against the bottle adjacent sides of the divider deforms the divider to move the divider cutout from over the ledge to over the lower area, thereby providing communication between the lower area and the upper area. Manipulation then allows a medicament stored in the lower area to fall into the upper area. The single medicament can then be dispensed through the cap window.

In one form, the combination medicine container and dispenser is designed to allow a user to dispense a single medicament through rotation of a rotary nest of the dispensing means. Rotation of the rotary nest aligns an indexer of the dispensing means to allow a single medicament of a particular size to be dispensed.

In an illustrative embodiment of a rotary form of the present combination medicine container and dispenser, the rotary combination medicine container and dispenser has a bottle with a generally cylindrical body defining an interior, an upper portion and a lower portion. The upper portion is configured to receive a cap, while the lower portion has a cutout configured to allow a single medicament to be dispensed therefrom. A divider is situated within the body to define an upper area and a lower area. The divider also includes a central boss and a configured cutout as part of the dispensing means to allow different sized medicaments to be dispensed from the bottle. An indexing cup is disposed on the boss of the divider within the upper area of the upper portion. The indexing cup has a cutout in its bottom that is configured and situated to cooperate with the configured cutout of the divider to allow a medicament to pass from the indexing cup to the lower area of the lower portion of the bottle. The indexing cup may be keyed to one of several cooperating structures on the inside surface of the upper portion in order to fix the rotational position of the indexing cup and register the cutout on the bottom of the indexing cup with a desired size of the slot of the bottle divider. This allows for dispensing medicaments of different sizes from the upper area to the lower area of the bottle. A rotary nest is received in the lower portion of the bottle and includes an inlet for receiving a medicament through the divider and indexing cup and an outlet that can rotationally register with the cutout of the lower portion of the bottle to dispense the medicament received at the inlet. The rotary nest includes a post or stem that extends through the divider boss, through the indexing cup, and into the cap. Rotation of the cap rotates the post which rotates the rotary nest. This allows the inlet and outlets of the rotary nest to selectively register or align with the cutouts of the divider and indexing cup as well as the bottle cutout on the lower portion thereof.

In another illustrative embodiment of a rotary form of the present combination medicine container and dispenser, the rotary combination medicine container and dispenser has a bottle with a generally cylindrical body defining an interior, an upper portion and a lower portion. The upper portion is configured to receive a cap, while the lower portion has a cutout configured to allow a single medicament to be dispensed therefrom. A divider is situated within the body to define an upper area and a lower area. The divider also includes a central boss and a cutout as part of the dispensing means to allow different sized medicaments to be dispensed from the bottle. An indexing disk, having a plurality of holes each one of a different size, is situated on the divider so as to rotate relative to the divider. This allows the indexing disk to align or register different size holes relative to the divider cutout to dispense different size medicaments. A rotary nest is received in the lower portion of the bottle and includes an inlet for receiving a medicament through the divider and indexing disk and an outlet that can rotationally register with the cutout of the lower portion of the bottle to dispense the medicament received at the inlet.

The present invention will be more apparent upon reading the following detailed description in conjunction with the accompanying drawings.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Like reference numerals indicate the same or similar parts throughout the several figures.

A detailed description of the features, functions and/or configuration of the components depicted in the various figures will now be presented. It should be appreciated that not all of the features of the components of the figures are necessarily described. Some of these non-discussed features as well as discussed features are inherent from the figures. Other non-discussed features may be inherent in component geometry and/or configuration.

DETAILED DESCRIPTION

Referring to FIGS. 1-15 there is depicted an illustrative embodiment of a combination medicine container and dispenser, generally designated 10, fashioned in accordance with the present principles and it components. The combination medicine container and dispenser 10 is configured to dispense a single pill (pill, tablet, capsule or the like) from the top thereof via an integral dispensing means or mechanism, being pressure properly applied to components of the container/dispenser 10 as discussed more fully below.

Figure 1:
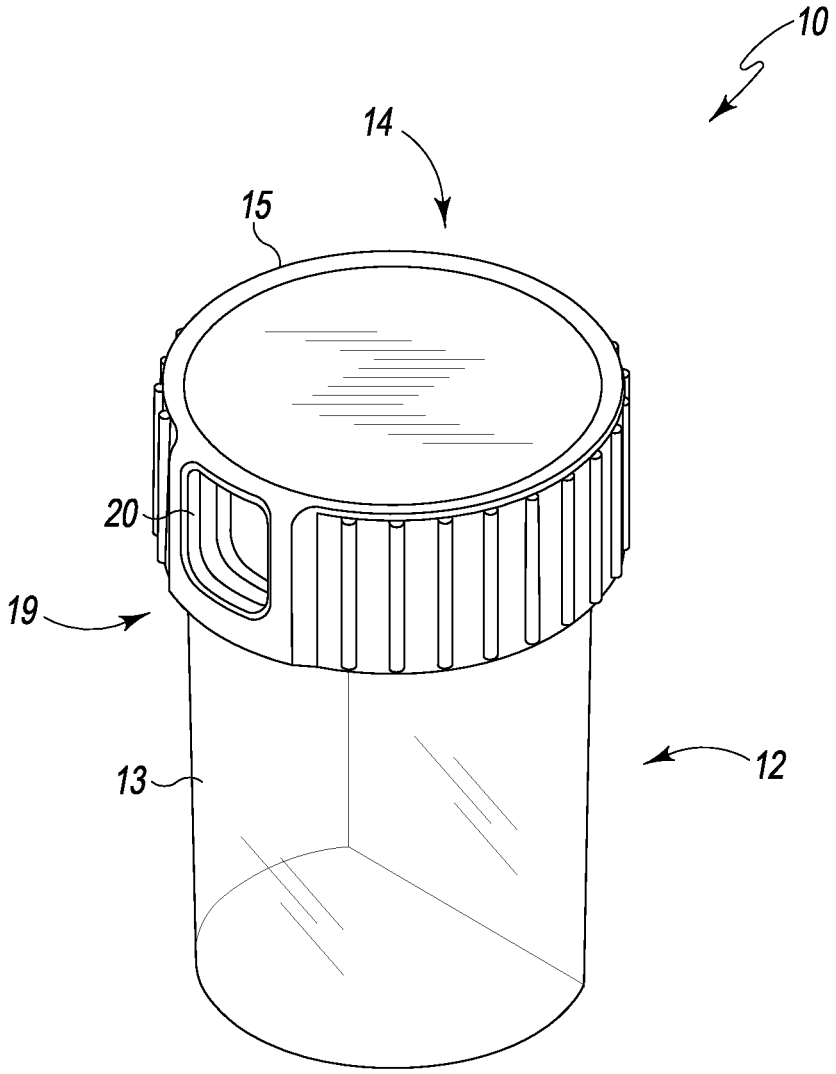
FIG. 1 is an isometric view of an embodiment of a combination medicine container and dispenser fashioned in accordance with the present principles.
Figure 2:
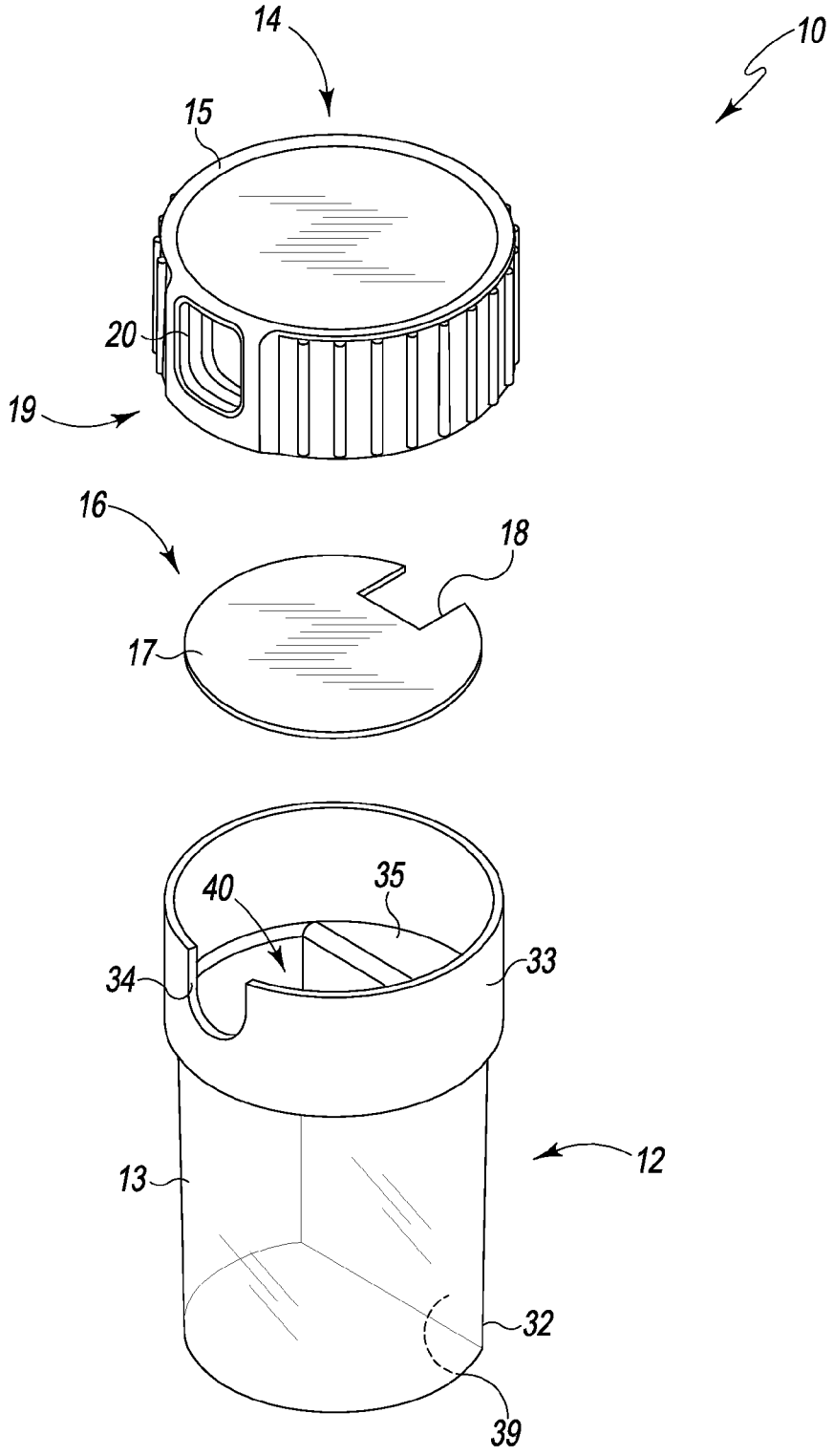
FIG. 2 is an exploded view of the combination medicine container and dispenser of FIG. 1.
Figure 3:
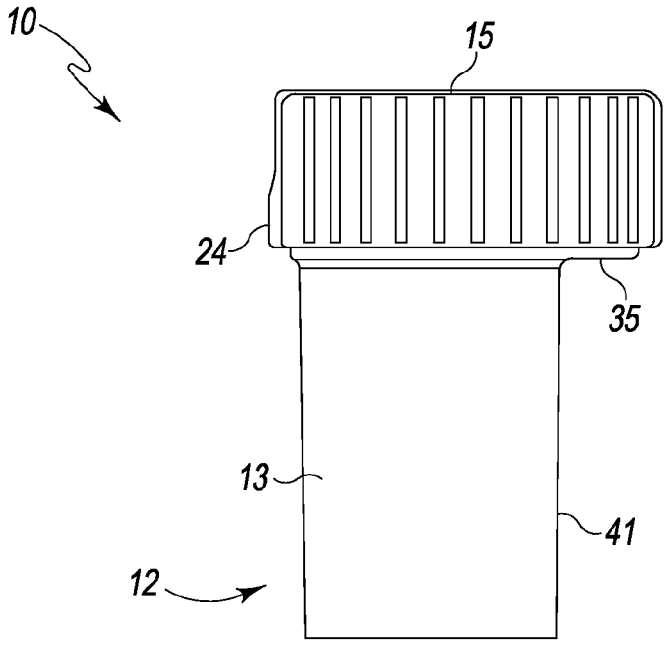
FIG. 3 is a side view of the combination medicine container and dispenser of FIG. 1, particularly showing the shape of the bottle thereof.
Figure 4:
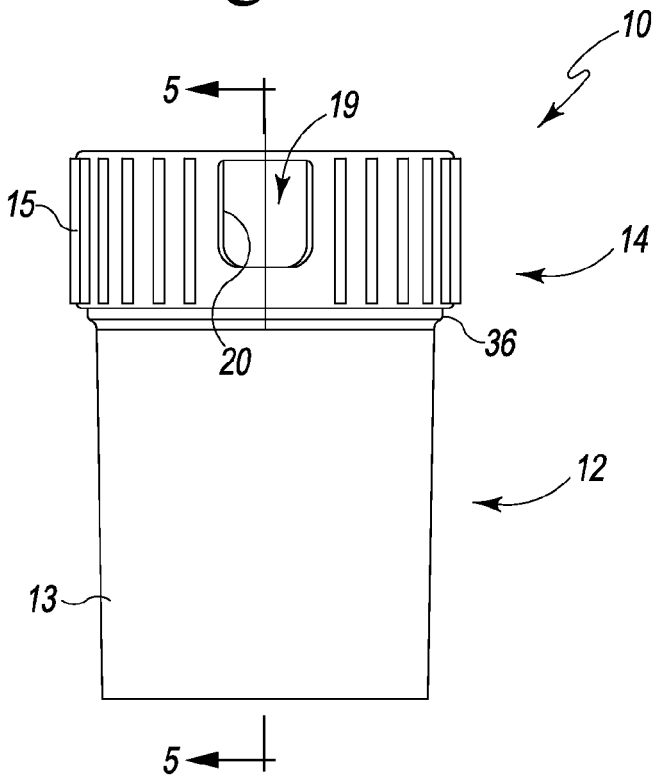
FIG. 4 is a side view of the combination medicine container and dispenser of FIG. 1, particularly showing the medicament dispensing outlet thereof.

FIG. 1 is an assembled view of the medicine container and dispenser 10 while FIG. 2 is an exploded view of the medicine container and dispenser 10 particularly showing the various components thereof. The medicine container and dispenser 10 includes a bottle 12, a cap 14, and a divider 16, with the dispensing means being a combination of features and/or structures of the bottle 12, cap 14 and divider 16. While these components are preferably made from plastic, one or more components may be made from other materials as desired. Plastics used may be an acrylic, PETE, or other.

The bottle 12 is defined by a generally cylindrical body 13 having a top portion 33 and a lower portion 32 that together define an interior 40. The body 13 further includes a cutout 34 formed in the top sidewall of the upper portion 33 of the body 13. The cutout 13 is sized to allow a single pill, tablet, capsule or the like (medicament) to be dispensed from the bottle 12 as described herein. As such, bottle 12 may be made having a different sized and/or configured cutout 34 depending on the type and/or size of the pill being held and dispensed.

A shelf or ledge 35 is provided in the interior 40 of the body 13 between the upper portion 33 and the lower portion 32 that is generally disposed opposite to the cutout 34. The lower portion 32, while being generally cylindrical, includes a flat wall 41 on the side which is under the shelf 35. As such, the flat wall 41 forms a flat inner wall 39. The shelf 35 thus extends over and beyond the flat wall 41. The shelf 27 defines an upper area that is within the upper portion 33 of the body 13, and a lower area that is within the lower portion 32 of the body 13. The medicament is stored in the lower area while a medicament is dispensed from the upper area.

The body 13 further includes a cap retention structure between the upper portion 33 and the lower portion 32. The upper portion 33 is slightly larger than the lower portion 32 and thus defines an overhang 37 (see, e.g. FIGS. 7-8). The overhang 37, in cooperation with structures on the cap (as described below), allow the cap to "snap-fit" onto the top portion 33. An annular ridge 36 is provided below the overhang 37 and around the body 13 creating a recessed band 38 around the body 13.

Figure 11:
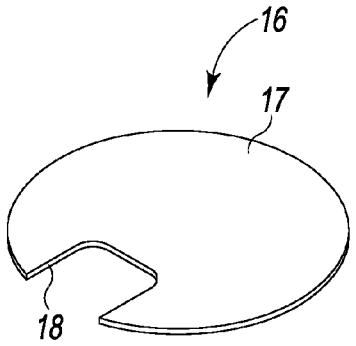
FIG. 11 is an isometric view of a divider of the combination medicine container and dispenser of FIG. 1.
Figure 15:
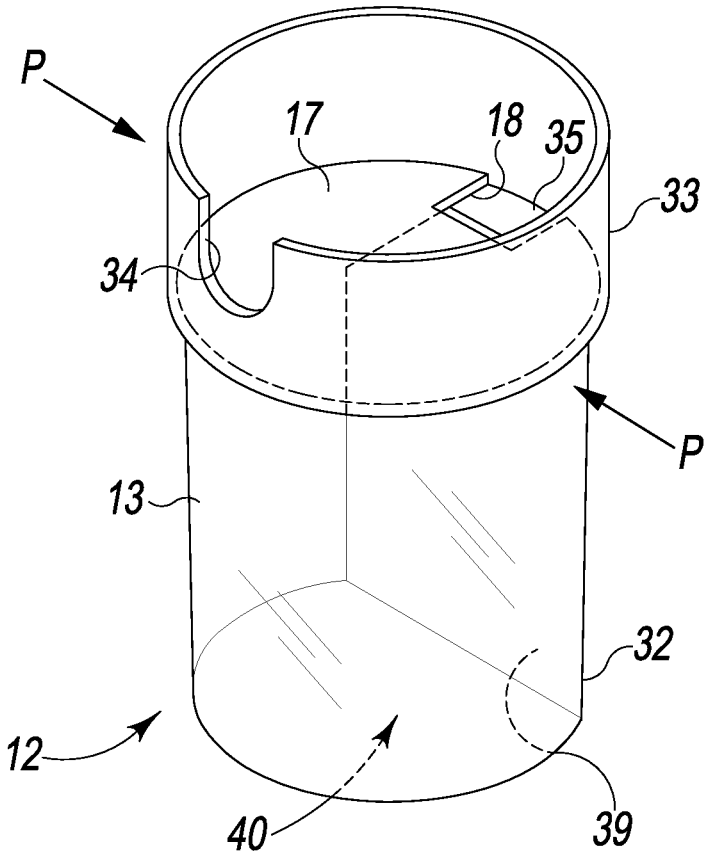
FIG. 15 is an isometric view of the combination medicine container and dispenser with the cap removed to illustrate its operation.

The divider is particularly shown in FIG. 11. The divider is defined by a generally round, flat disk 17 with a notch 18 provided in an edge of the disk 17. As seen in FIG. 15, wherein the cap 14 is not shown, the disk 17 is shown situated in the bottle 12. The divider 16 is sized so as to completely divide the upper area of the upper portion 33 from the lower area of the lower portion 32. The notch 18 is positioned over the shelf 35. In the position shown, medicaments (not shown) in the lower area of the lower portion 32 are blocked from entering the upper area of the upper portion 32. However, when pressure P is applied to the sides of the bottle 13 as indicted by the arrows in FIG. 15 (but not particularly at the points on the body 13 as shown by the arrows, as the pressure may be applied to different points about the bottle 13 in order for the divider to operate in the manner described herein), the divider deforms slightly such that the notch 18 moves away from the shelf 35, thereby allowing a single medicament (not shown) to pass from the lower area of the lower portion 32 to the upper area of the upper portion 33. Release of the pressure allows the divider to return to its normal unbiased state as shown in FIG. 15. Once the medicament is in the upper area of the upper portion 33, it can be dispensed through the notch 34 of the bottle 13 and a window 20 of the bottle 13 (collectively, medicament outlet 19, see e.g. FIG. 1). The notch 18 is preferably, but not necessarily, disposed at the middle of the shelf edge.

Figure 5:
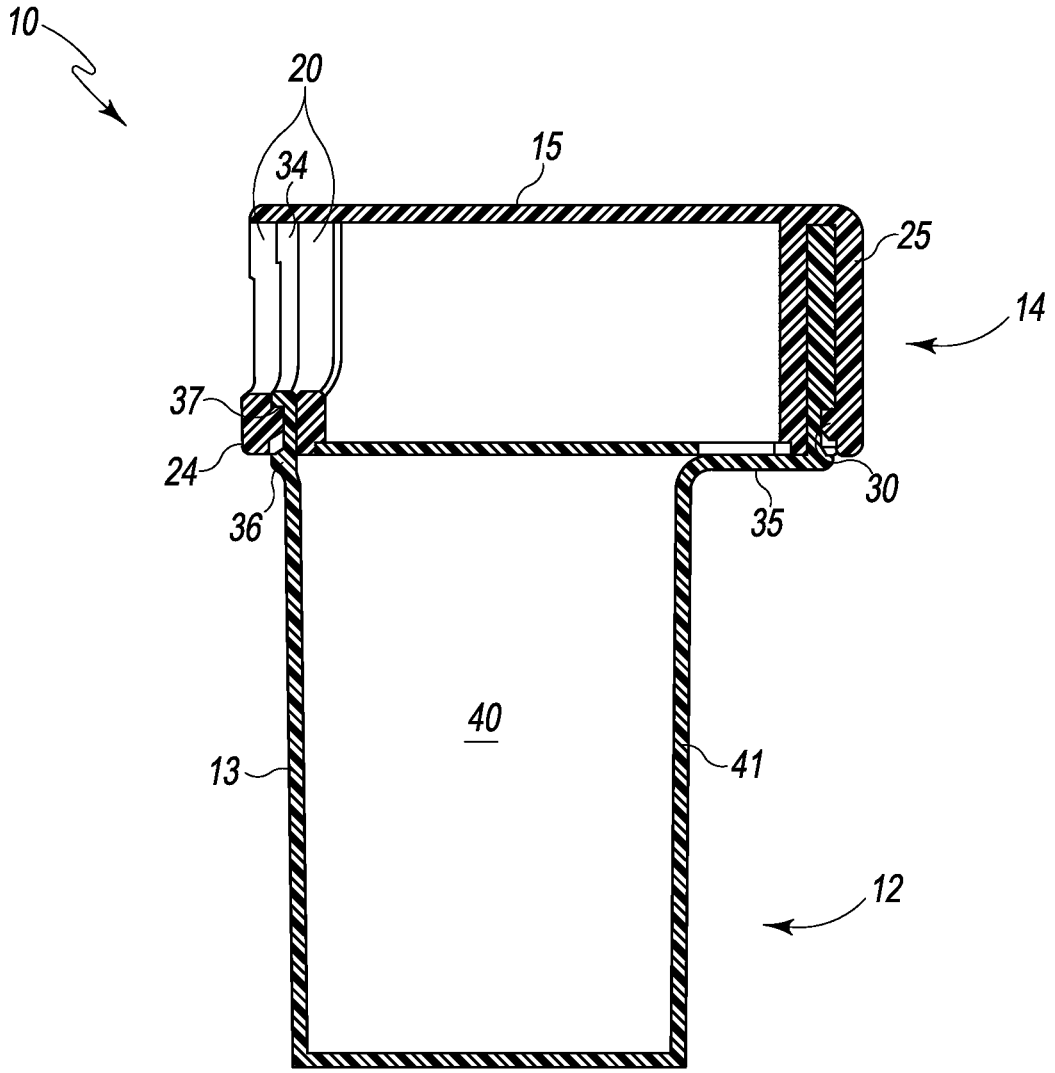
FIG. 5 is a sectional view of the combination medicine container and dispenser of FIG. 4 taken along line 5-5 thereof.
Figure 6:
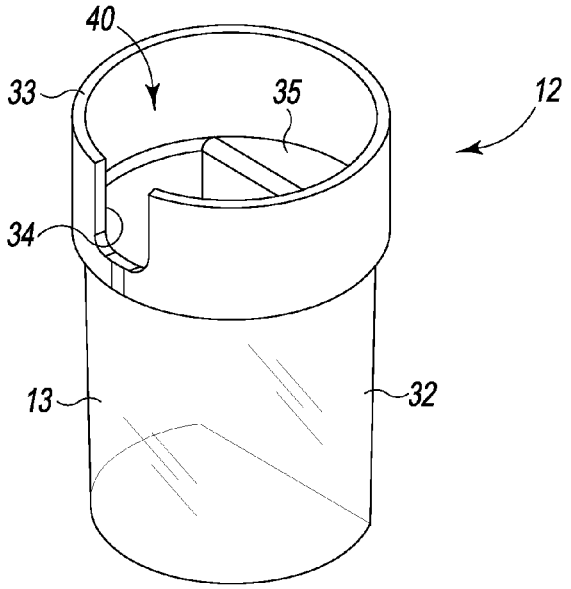
FIG. 6 is an isometric view of the bottle of the combination medicine container and dispenser of FIG. 1.
Figure 7:
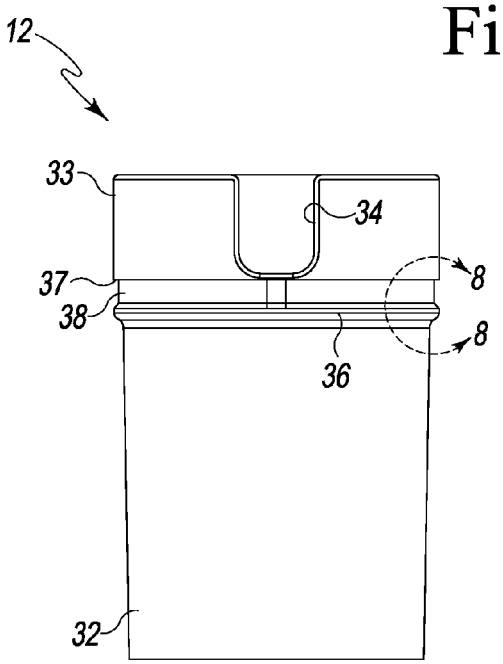
FIG. 7 is a side view of the bottle of FIG. 6, particularly showing a medicament opening and cap reception structure thereof.
Figure 8:
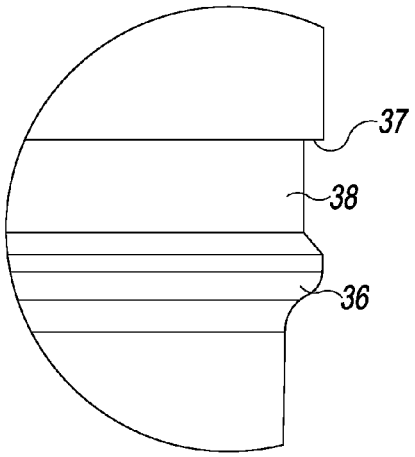
FIG. 8 is an enlarged view of a portion of the cap reception structure of the bottle of FIG. 7 taken along circle 8-8 thereof.
Figure 9:
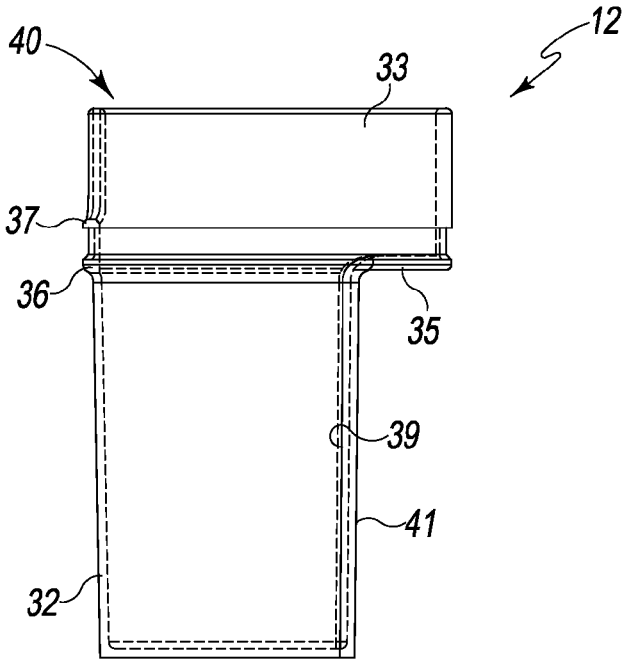
FIG. 9 is a side view of the bottle of FIG. 6, particularly showing its shape.
Figure 10:
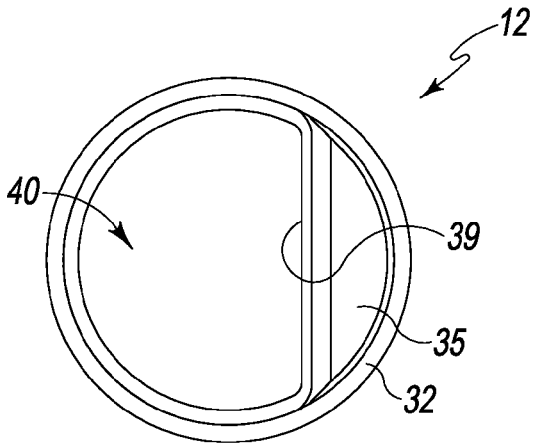
FIG. 10 is a top view of the bottle of FIG. 6, particularly showing an inner ledge of the bottle of FIG. 6.
Figure 14:
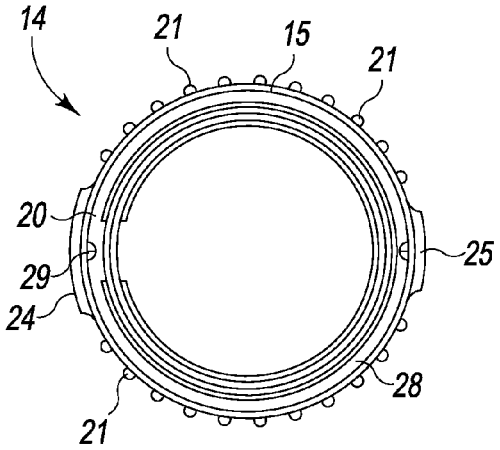
FIG. 14 is a bottom plan view of the cap of FIG. 12, particularly showing its internal structures.
Figure 12:
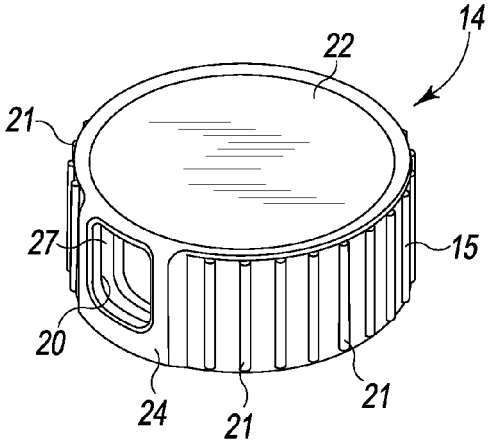
FIG. 12 is an isometric top view of a cap of the combination medicine container and dispenser of FIG. 1.
Figure 13:
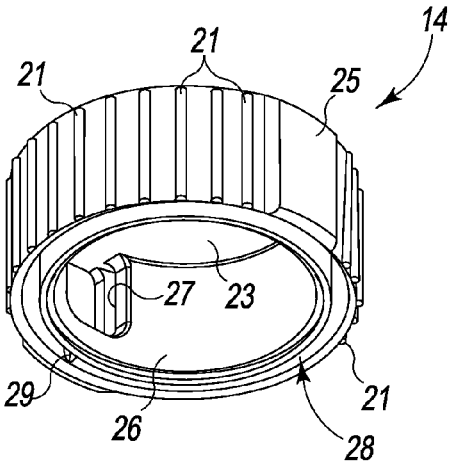
FIG. 13 is an isometric bottom view of the cap of FIG. 12.

Referring to FIGS. 12-14, the cap 14 is particularly shown. The cap 14 is defined by a body 15 that is generally cylindrical in shape and defines an upper surface 22 and a lower surface 23. The upper surface 22 may include writing, indicia or the like if desired, or allow labels to adhere thereto. The body 15 has a plurality of vertically disposed gripping ribs 21 on its outside surface. A window 20 is provided in a boss 24 of one side of the annular wall of the body 15. On the inside surface of the annular wall of the body 15 adjacent the boss 24 is a projection 29 that is used to attach the cap 14 to the bottle 12. A boss 25 is provided in the side of the annular wall of the body 15 opposite the boss 24. A projection 30 is provided on the inside surface of the annular wall of the body 15 adjacent the boss 25 that is likewise use to attach the cap 14 to the bottle 12. As best discerned in FIGS. 13 and 14, an annular wall 26 is provided on the inside of the body 13 that is radially inward of the annular wall of the cap 14. As such, an annular space 28 is defined between the walls. As best seen in FIG. 5, the top of the bottle 12 fits into the annular space 28. The annular inside wall 26 has a cutout 27 that is aligned with the cutout 20 of the annular wall of the cap 14 such that the medicament outlet 19 is formed by cutouts 20 and 27. This allows a medicament to be dispensed from the upper area of the upper portion 33 of the bottle 12 via the medicament outlet 19.

Referring now to FIGS. 16-31 there is depicted another illustrative embodiment of a combination medicine container and dispenser, generally designated 50, fashioned in accordance with the present principles and it components. The combination medicine container and dispenser 50 is configured to dispense a single pill (pill, tablet, capsule or the like) from the top thereof via thereof via an integral dispensing means or mechanism, being rotary motion applied to components of the container/dispenser 50 as discussed more fully below.

Figure 16:
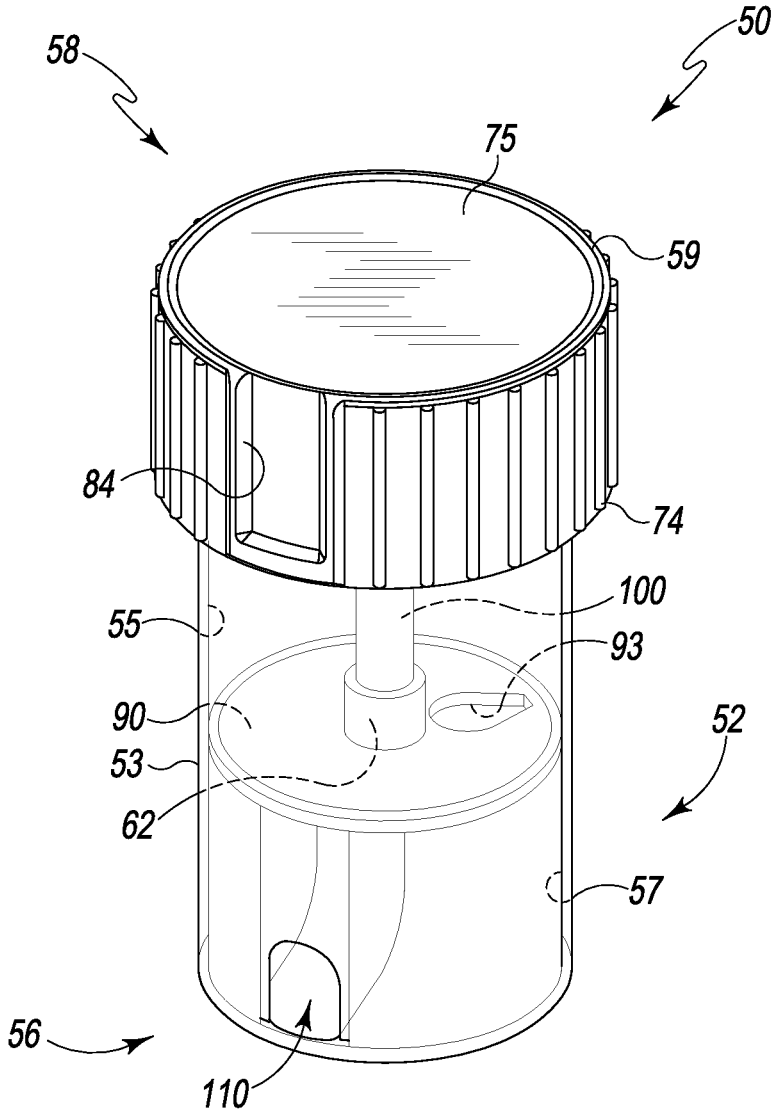
FIG. 16 is an isometric view an embodiment of a combination medicine container and dispenser fashioned in accordance with the present principles.
Figure 17:
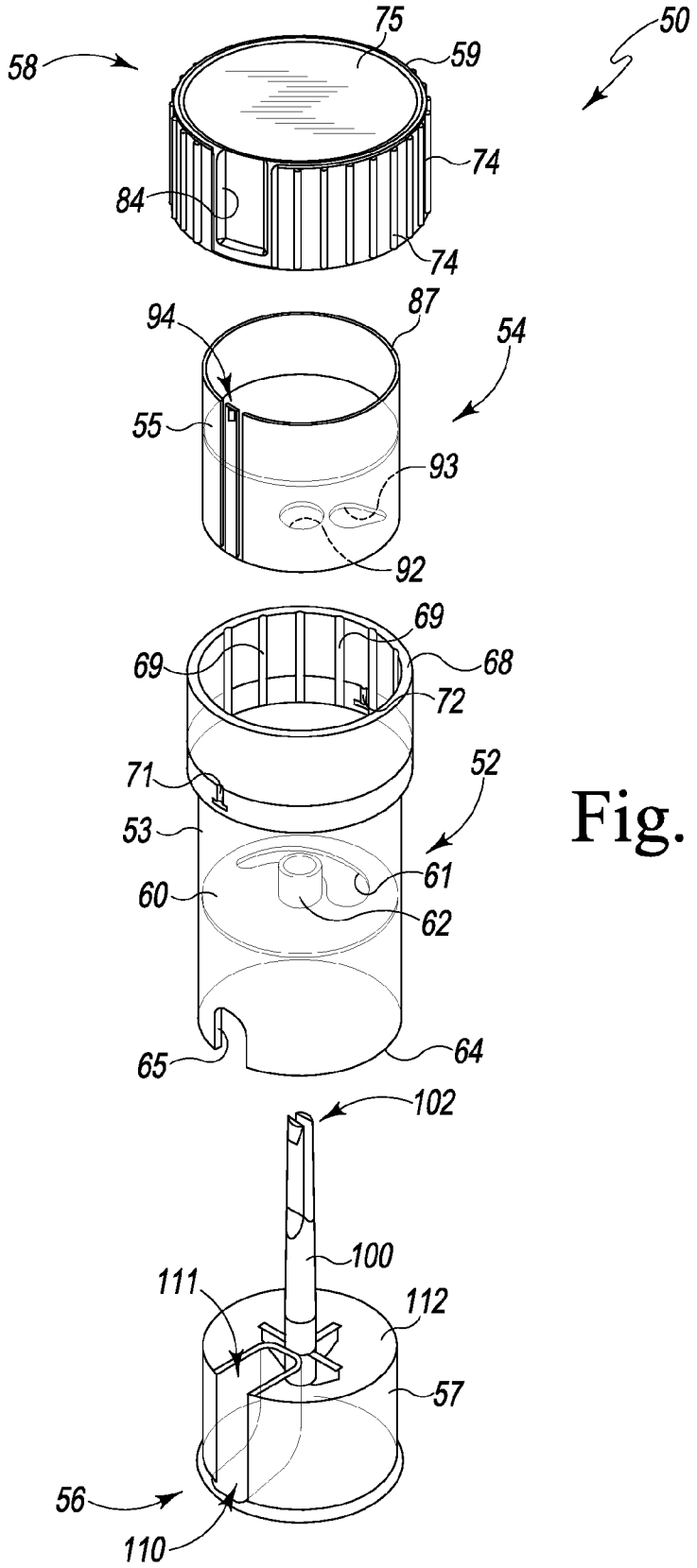
FIG. 17 is an exploded view of the combination medicine container and dispenser of FIG. 16.

FIG. 16 is an assembled view of the medicine container and dispenser 50 while FIG. 17 is an exploded view of the present medicine container and dispenser 50 particularly showing the various components thereof. The medicine container and dispenser 50 includes a bottle 52, an indexing cup 54, a rotary dispenser or nest 56, and a cap 58, with the dispensing means being a combination of features and/or structures of the various components. While these components are preferably made from plastic, one or more components may be made from other materials as desired. Plastics used may be an acrylic, PETE, or other.

Figure 20:
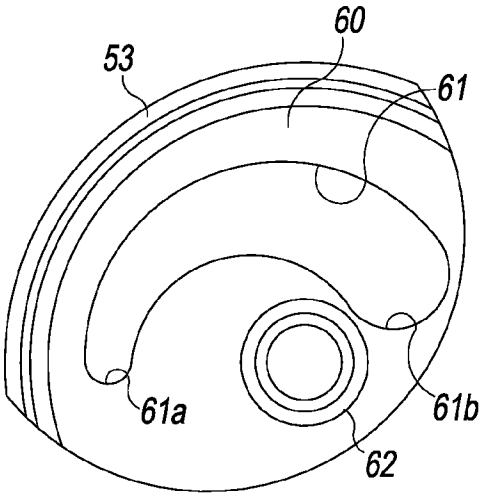
FIG. 20 is an enlarged top plan view of the divider of the bottle as shown in FIG. 19 taken along circle 20-20 thereof.
Figure 19:
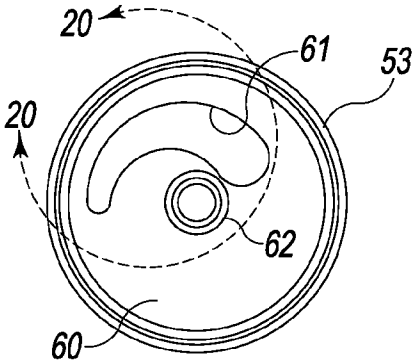
FIG. 19 is a top plan view of the bottle of FIG. 18, particularly showing a divider of the bottle, the divider having a configured slot for dispensing medicaments.
Figure 18:
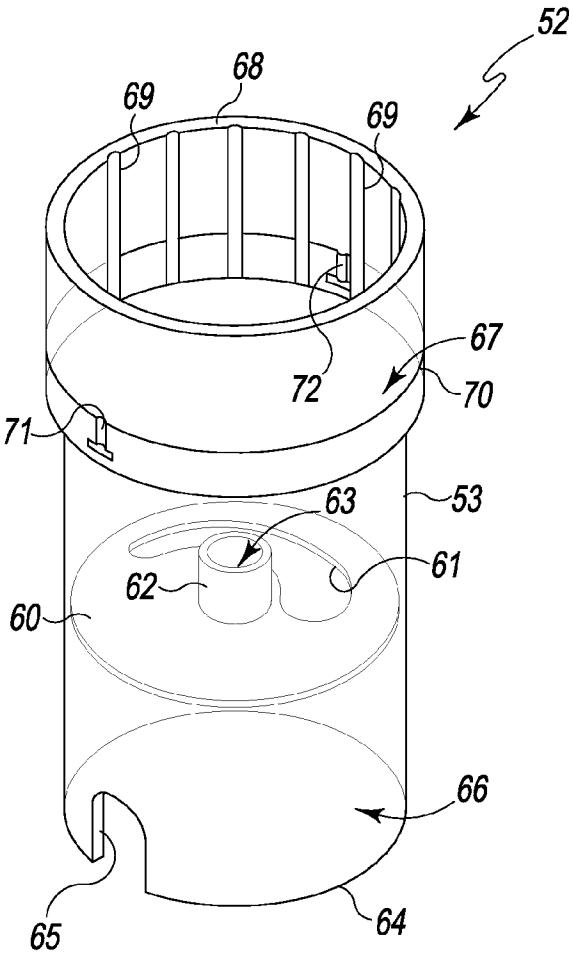
FIG. 18 is an isometric view of the bottle of the combination medicine container and dispenser of FIG. 16.

With particular reference to FIGS. 18-20, the bottle 52 is defined by a generally cylindrical body 53 having a top portion 70 defining an upper area 67 within its interior, and a lower portion 64 defining a lower area 66 within its interior. The body 53 further includes a cutout 65 formed in the lower sidewall of the lower portion 64 of the body 53. The cutout 65 is sized to allow a single pill, tablet, capsule or the like (medicament) to be dispensed from the bottle 52 as described herein. As such, bottle 52 may be made having a different sized and/or configured cutout 65 depending on the type and/or size of the pill being held and dispensed.

A divider or shelf 60 is provided in the interior 66 of the lower portion 64 of the body 53 generally proximate the cutout 65 such that a lower area is defined between the divider 60 and the lower end of the lower portion 64. The single medicament is dispensed from the lower area. The divider 60 includes a central boss 62 having a bore 63 extending through the boss 62. A slot 61 is provided in the divider 60. The slot 61 is configured so its side walls define a varying width. Particularly, the slot 61 is configured as an arch or a portion of a spiral having a narrow end 61*a* and a large end 61*b* (see FIG. 20). Exemplary dimensions are from a narrow end 61*a* of 4 mm to a large end 61*b* of 12 mm. Of course, other dimensions may be used.

The upper portion 70 of the body 53 includes a cap retention structure approximately between the upper portion 70 and the lower portion 64 of the body 53. The upper portion 70 may be slightly larger than the lower portion 64 and thus defines a slight overhang. On the outside surface of the upper portion 70 proximate the overhang is a first configured slot 71 and a second configured slot 72. As seen in FIGS. 17 and 18, the slots are disposed diametrically opposite one another. However, it should be recognized that more than two configured slots may be used or similar structures. The slots 71, 72 cooperate with structures on the cap (as described below), allowing the cap to attach onto the top portion 33 and rotate. While not shown, child-proof structures may be incorporated into this as well as the other embodiments.

The upper portion 70 of the body further includes a plurality of vertical grooves 69 on the inside surface of the upper portion 70. As discussed more fully below, the vertical grooves 69 cooperate with a mating structure 94 of the indexing cup 94 to allow the indexing cup 54 to be retained in a particular rotational position, thereby setting the size of a medicament that the container/dispenser 50 can singularly dispense from a range of medicament sizes. The grooves can be marked to show the chosen opening diameter for the medicament.

Figure 26:
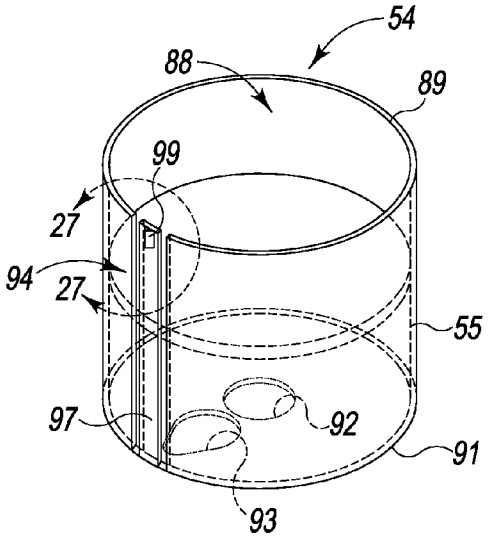
FIG. 26 is another isometric view of the indexing cup of FIG. 25.
Figure 27:
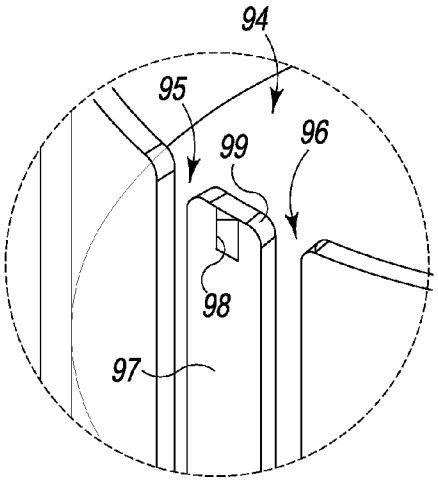
FIG. 27 is an enlarged view of a portion of a reception structure of the indexing cup.
Figure 25:
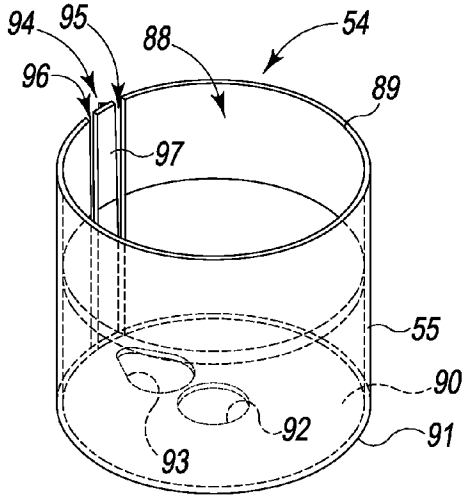
FIG. 25 is an isometric view of an indexing cup of the combination medicine container and dispenser of FIG. 16.
Figure 28:
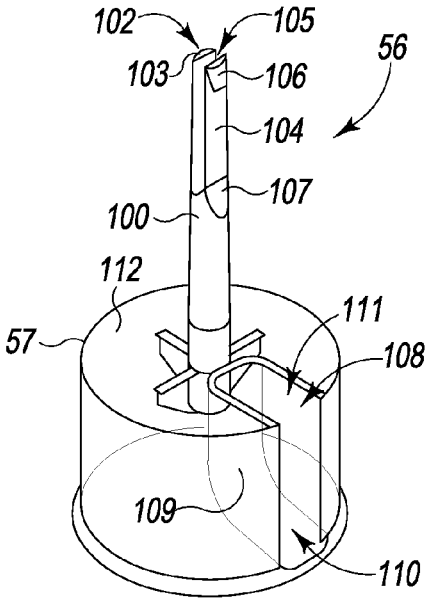
FIG. 28 is an isometric view of a rotary nest structure of the combination medicine container and dispenser of FIG. 16.
Figure 29:
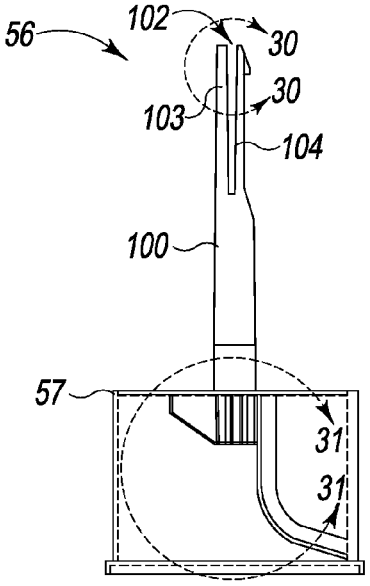
FIG. 29 is a side view of the rotary nest structure of FIG. 28.
Figure 30:
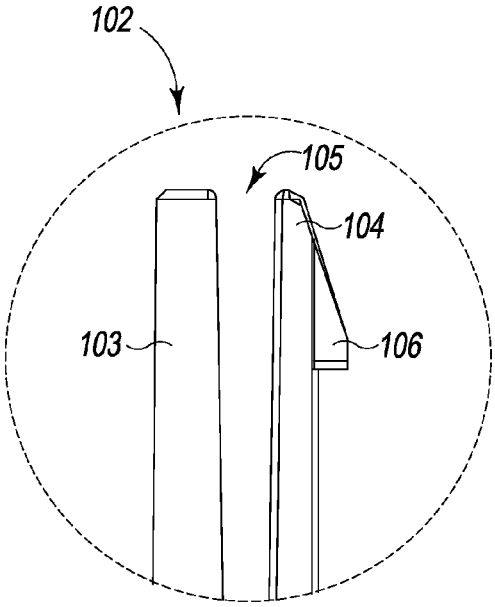
FIG. 30 is an enlarged view of a reception structure of a post of the rotary nest structure of FIG. 29 taken along circle 30-30 thereof.
Figure 31:
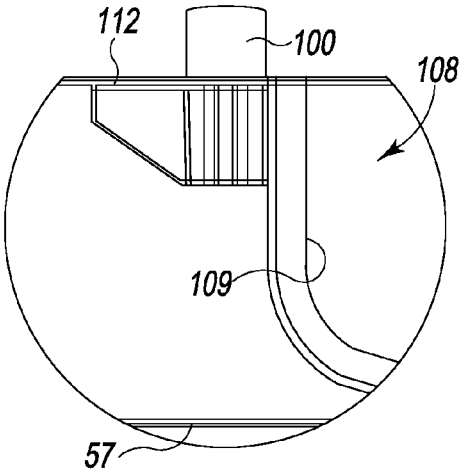
FIG. 31 is an enlarged view of a portion of the base of the rotary nest structure of FIG. 29 taken along circle 31-31 thereof.

The indexing cup 54 is particularly shown in FIGS. 25-27. The indexing cup 54 has a generally cylindrical body 55 with a closed bottom 91 and an open top 89 thus defining an interior 88. A central bore 92 is provided in the bottom as well as a configured hole or slot 93. The configured hole 93 is shaped to have a radial center line that registers or indexes with the slot 61 of the divider 60 of the bottle 52. Rotation of the indexing cup 54 relative to the divider 60 creates an opening between the upper area 67 and the lower area 66 of a particular size. Referring to FIG. 27, the mating structure 94 of the indexing cup is best seen. The mating structure 94 includes a key 98 projecting from the end 99 of a finger or tine 97 formed by first and second slots 95, 96. The key 98 mates with the grooves 69 of the upper portion 70 of the body 53. Particularly, the indexing cup is received in the bottle 52 from the top with the rotational position thereof fixed by the reception of the key 98 in one or the grooves 69. Rotational position of the indexing cup 54 determines the size of the hole between the medicament holding area and the medicament dispensing area. The indexing cup 54 is what holds the medicaments to be dispensed. Once the indexing cup 94 is positioned and the cap 58 is attached to the bottle 52, the indexing cup 94 is stationary and never moves.

Referring to FIGS. 21-24, the cap 58 is particularly shown. The cap 58 is defined by a body 59 that is generally cylindrical in shape and defines an upper surface 75 and a lower surface 76. The upper surface 75 may include writing, indicia or the like if desired, or allow labels to adhere thereto. The body 59 has a plurality of vertically disposed gripping ribs 74 on its outside surface. A gripping/thumb area 84 is provided on the side of the annular wall of the body 59. Another gripping/thumb area 82 is provided on the side of the annular wall of the body 59 diametrically opposite the gripping/thumb area 84. On the inside surface of the annular wall of the body 59 adjacent the gripping/thumb area 84 is a projection 85 that is used to attach the cap 58 to the bottle 52. A projection 83 is provided on the inside surface of the annular wall of the body 59 adjacent the gripping/thumb area 82 that is likewise used to attach the cap 58 to the bottle 52.

Figure 22:
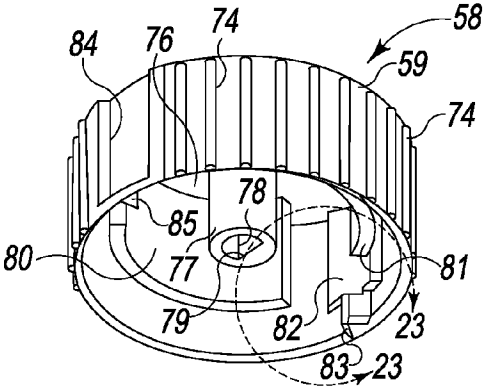
FIG. 22 is an isometric bottom view of the cap of FIG. 21, particularly showing a portion of its internal structure.
Figure 23:
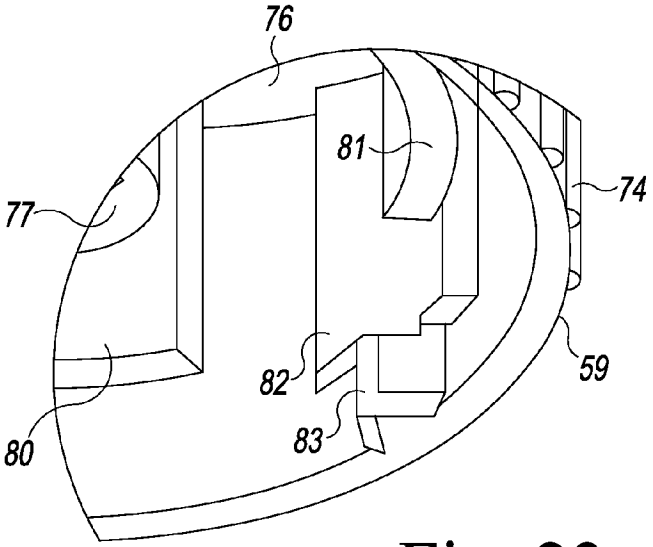
FIG. 23 is an enlarged view of a portion of the inside of the cap of FIG. 22 taken along circle 23-23 thereof.
Figure 21:
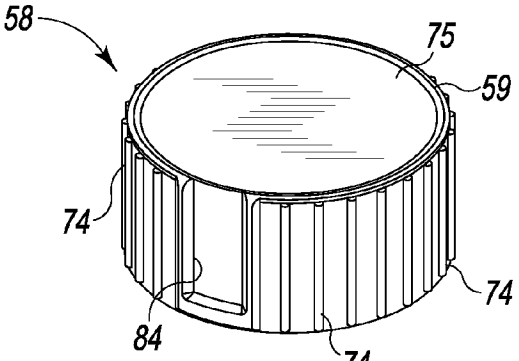
FIG. 21 is an isometric top view of a cap of the combination medicine container and dispenser of FIG. 16.
Figure 24:
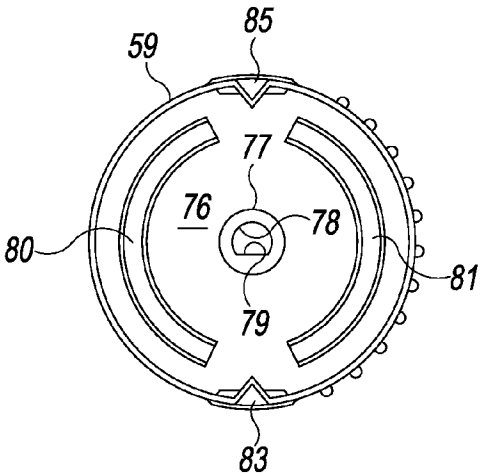
FIG. 24 is a bottom plan view of the cap of FIG. 21, particularly showing its internal structure.

As best discerned in FIGS. 22 and 24, a first annular wall 80 extends from the bottom 76 of the body 59 and is positioned radially inward of the annular wall of the cap 58. The first annular wall 80 is arch shaped and extends only a portion around a stem 77 of the cap 58. A second annular wall 81 extends from the bottom 76 of the body 59 and is positioned radially inward of the annular wall of the cap 58. The second annular wall 81 is arch shaped and extends only a portion around the stem 77. As such, an annular space is defined between the inner walls 80, 81 and the annular wall of the cap 58. In like manner as the embodiment of FIG. 5, the top of the bottle 52 fits into the annular space of the cap 58.

The stem 77 of the cap 58 extends axially from the bottom 76 of the cap body 59. A bore 78 extends through the stem 77 preferably, but not necessarily, from the top of the stem 77 to the bottom 76 of the cap 58. A flat 79 is formed in the bore 78. The flat 79 allows the stem 100 of the rotary dispenser 56 to be keyed thereto, such that rotation of the cap rotates the stem 100 which rotates the rotary dispenser 56.

Referring to FIGS. 28-31, the rotary dispenser or nest 56 is shown. The rotary dispenser 56 has a generally cylindrical body 57 with the post or stem 100 extending vertically from a top 112 of the body 57. One side of the cylindrical body 57 has a channel 108 formed therein which defines an inlet 111 in the top surface 112 of the body 57 and an outlet 110 in the side of the body 57. A dispensing surface 109 is also defined that extends between the inlet 111 and the outlet 110. When the rotary nest 56 is rotated, the inlet 111 can be registered under the hole 61 of the divider 69 and hole 93 of the indexing cup 54 to receive a single medicament, while the outlet 110 can be registered adjacent the cutout 65 in the bottom of the bottle 52 in order to dispense the single medicament.

The tip 102 of the post 100 has a mating structure or bard that is configured for reception in the stem 77 of the cap 58. As best seed in FIGS. 28-30, the tip 102 has a vertical slot 105 that extends axially down the post 100 to define a first tine 103 and a second tine 104. A projection 106 is provided at the top of the tine 104. The bottom of the tine 104 includes a taper 107. This structure locks the cap 58 to the rotary nest 56.

In use, the indexing cup 54 is filled with the medicament. The indexing cup 54 is placed into the bottle 52 in a rotational position to register or align the hole 93 of the indexing cup 54 with a portion of the slot 61 of the divider such that the size of the resultant opening will allow a single medicament to pass therethrough. The projection 98 of the indexing cup 54 is received the appropriate groove 69 of the bottle 52. The cap 58 is then locked onto the post 100 of the rotary nest 56. Rotation of the cap 58 rotates the rotary nest 56 as described above to dispense a medicament.

Referring now to FIGS. 32-45 there is depicted another illustrative embodiment of a combination medicine container and dispenser, generally designated 130, fashioned in accordance with the present principles and it components. The combination medicine container and dispenser 130 is configured to dispense a single pill (pill, tablet, capsule or the like) from the bottom thereof via thereof via an integral dispensing means or mechanism, being rotary motion applied to components of the container/dispenser 130 as discussed more fully below.

Figure 32:
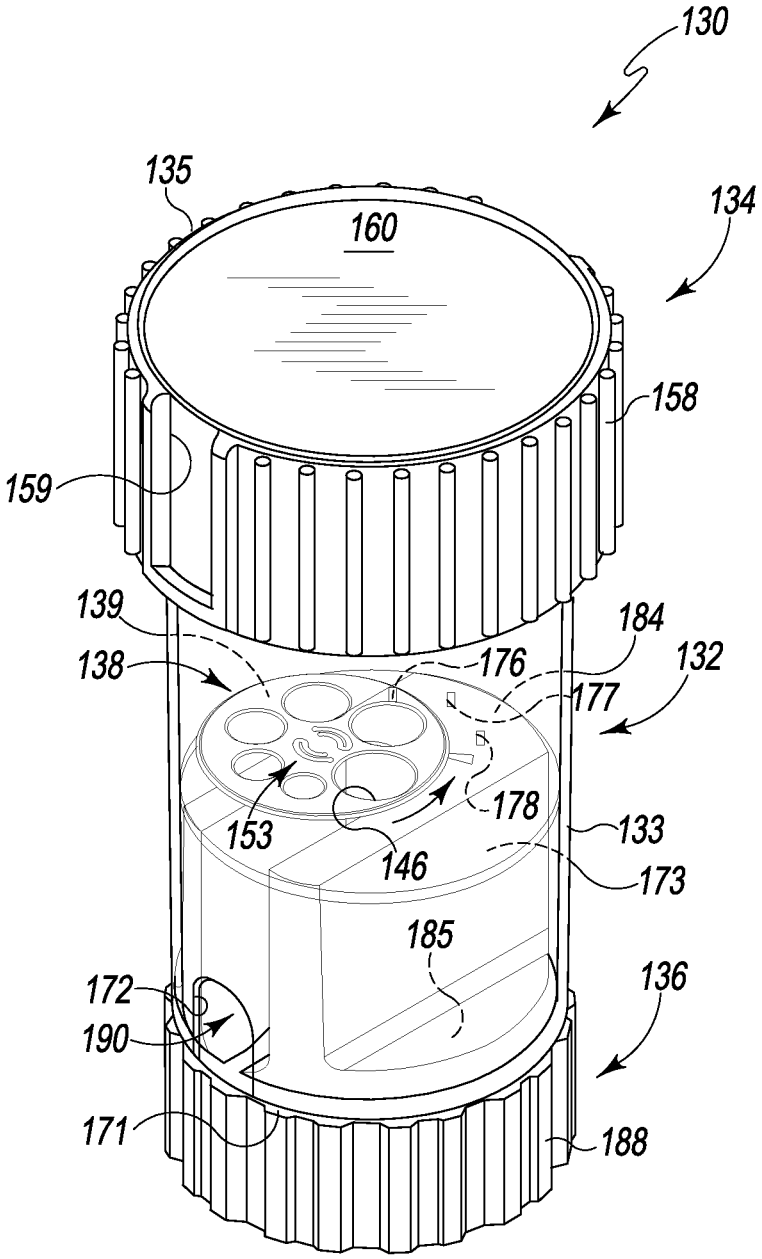
FIG. 32 is an embodiment of a combination medicine container and dispenser fashioned in accordance with the present principles.
Figure 33:
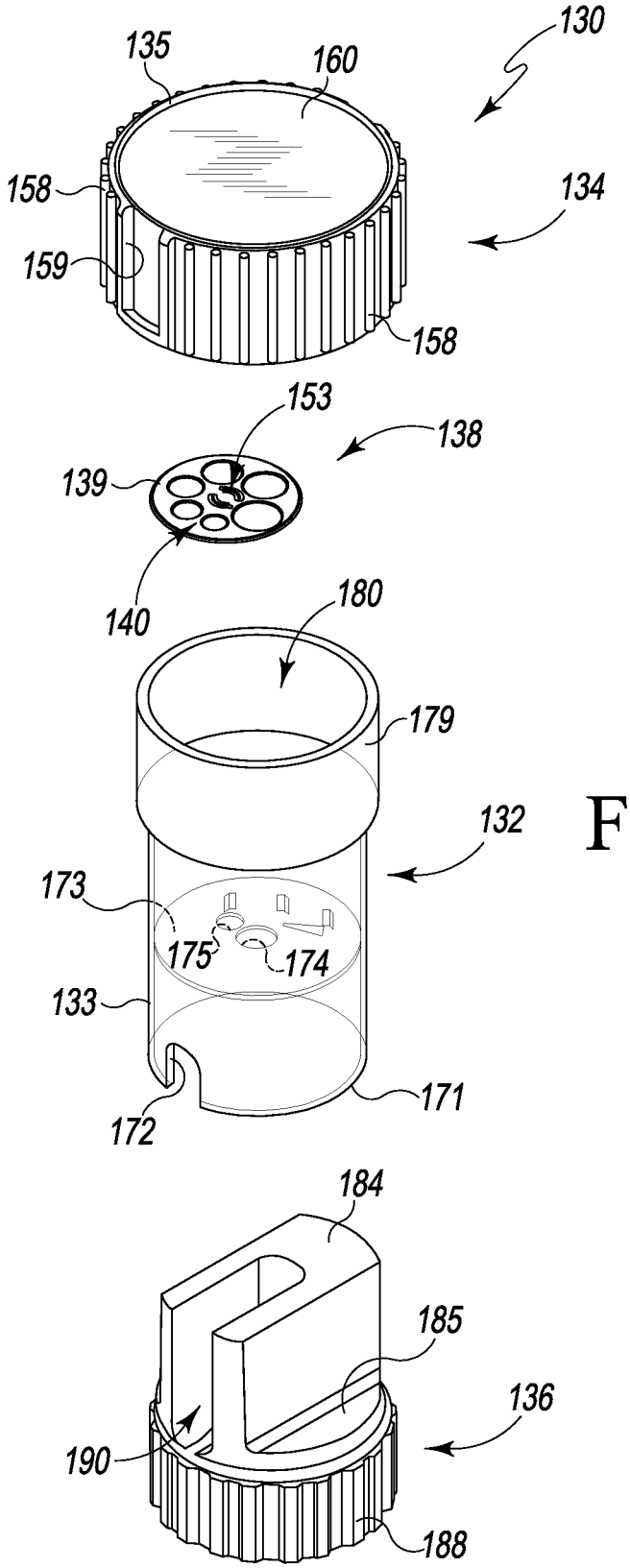
FIG. 33 is an exploded view of the combination medicine container and dispenser of FIG. 32.

FIG. 32 is an assembled view of the medicine container and dispenser 130 while FIG. 33 is an exploded view of the present medicine container and dispenser 130 particularly showing the various components thereof. The medicine container and dispenser 130 includes a bottle 132, a cap 134, indexing disk 138, and a rotary dispenser or nest 136, with the dispensing means being a combination of features and/or structures of the various components. While these components are preferably made from plastic, one or more components may be made from other materials as desired. Plastics used may be an acrylic, PETE, or other.

Figure 34:
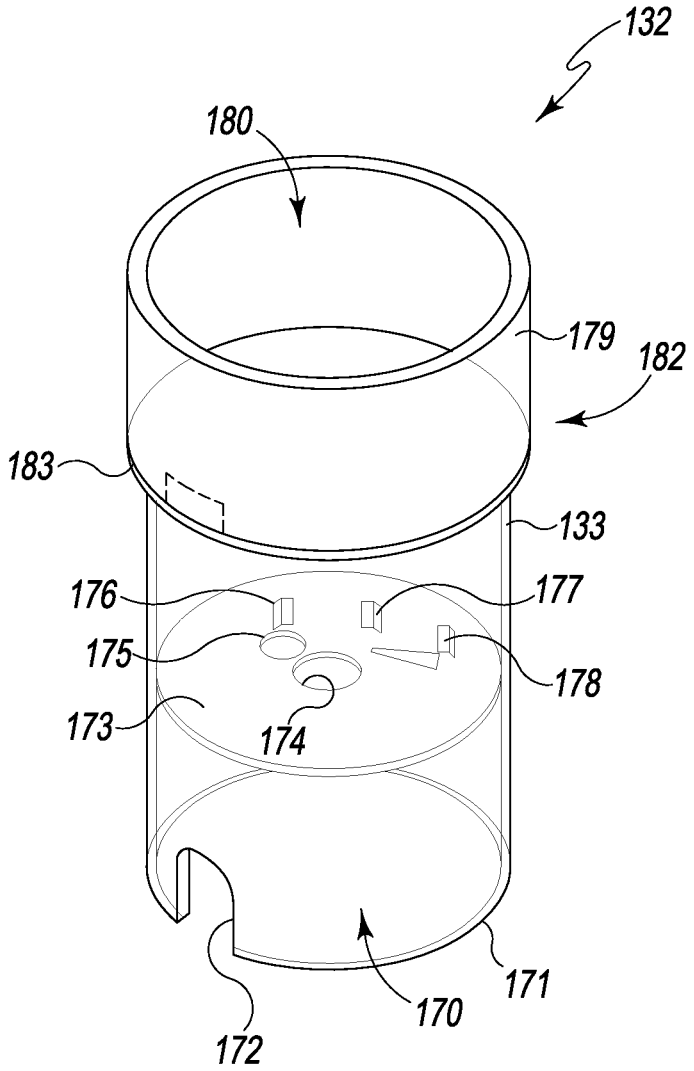
FIG. 34 is an isometric view of a bottle of the combination medicine container and dispenser of FIG. 32.
Figure 36:
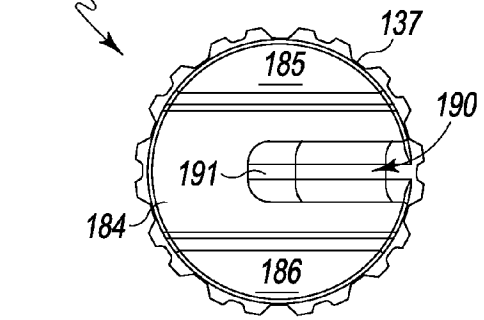
FIG. 36 is a top plan view of the rotary nest of FIG. 35.
Figure 38:
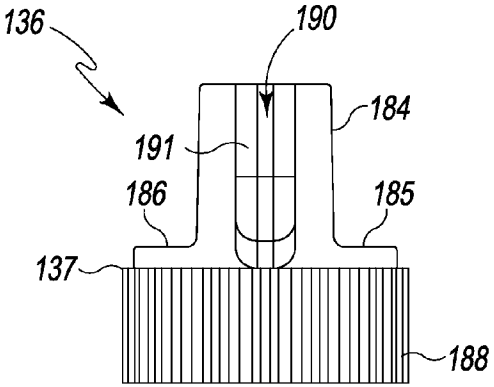
FIG. 38 is a side view of the rotary nest of FIG. 35.
Figure 35:
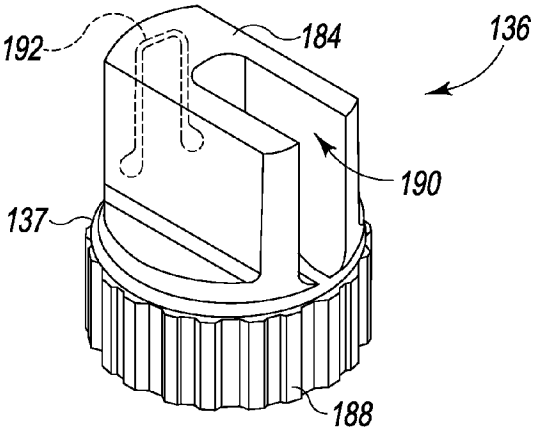
FIG. 35 is an isometric view of the rotary nest of the combination medicine container and dispenser of FIG. 32.
Figure 37:
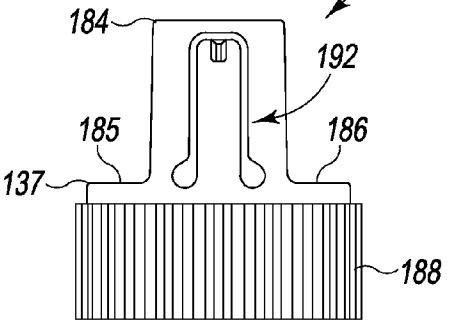
FIG. 37 is a side view of the rotary nest of FIG. 35.

With particular reference to FIG. 34, the bottle 132 is defined by a generally cylindrical body 133 having an upper portion 179 defining an upper area 180 within its interior, and a lower portion 171 defining a lower area 170 within its interior. The body 133 further includes a cutout 172 formed in the lower sidewall of the lower portion 171 of the body 133. The cutout 172 is sized to allow a single pill, tablet, capsule or the like (medicament) to be dispensed from the bottle 132 as described herein. As such, bottle 132 may be made having a different sized and/or configured cutout 172 depending on the type and/or size of the pill being held and dispensed.

A divider or shelf 173 is provided in the interior 170 of the lower portion 171 of the body 133 generally proximate the cutout 172 such that a lower area is defined between the divider 173 and the lower end of the lower portion 171. The single medicament is dispensed from the lower area. The divider 173 includes a central bore 174 and a medicament hole 175 adjacent the central bore 174. The divider 173 further has three upstanding guides 176, 177, 178 for retaining and stabilizing the indexing disk 138.

The upper portion 179 of the body 133 includes a cap retention structure approximately between the upper portion 179 and the lower portion 171 of the body 133. The upper portion 179 may be slightly larger than the lower portion 171 and thus defines a slight overhang. The overhang cooperate with structures on the cap (as described below), allowing the cap to attach onto the top portion 33 and rotate. While not shown, child-proof structures may be incorporated into this as well as the other embodiments.

Figure 40:
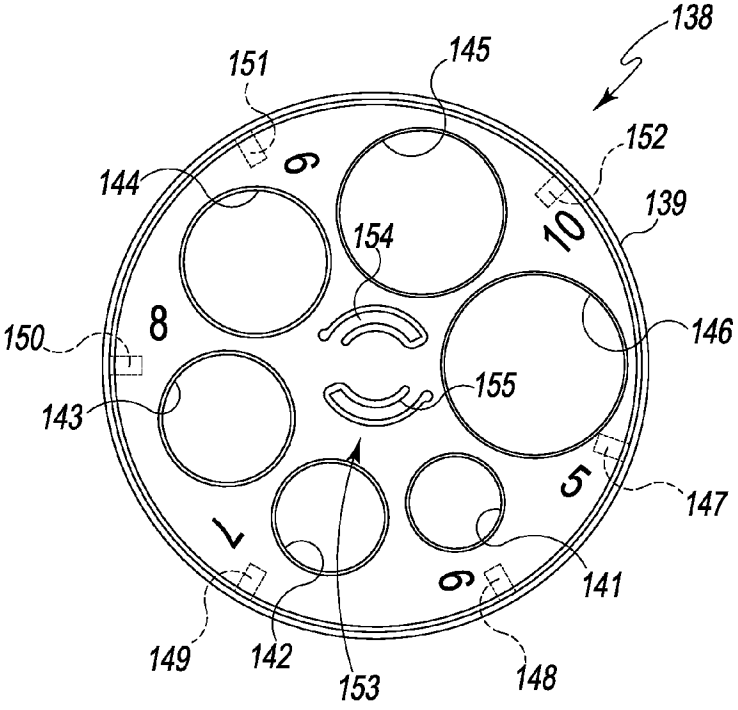
FIG. 40 is a top plan view of the indexing disk of FIG. 39.
Figure 39:
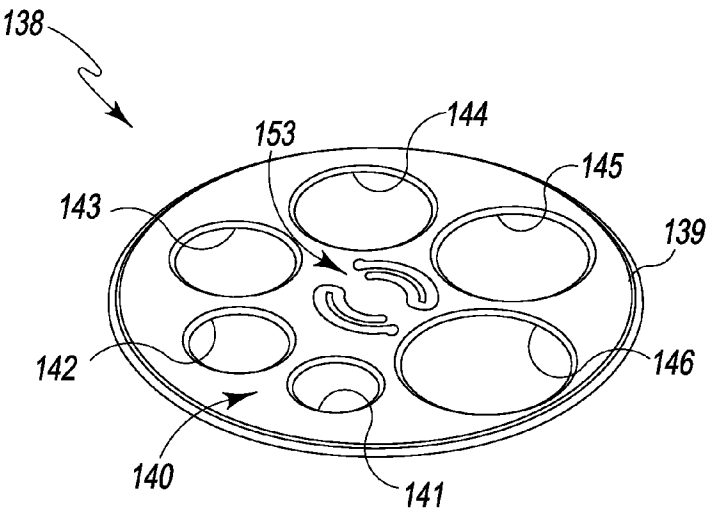
FIG. 39 is an isometric view of the indexing disk of the combination medicine container and dispenser of FIG. 32.
Figure 41:
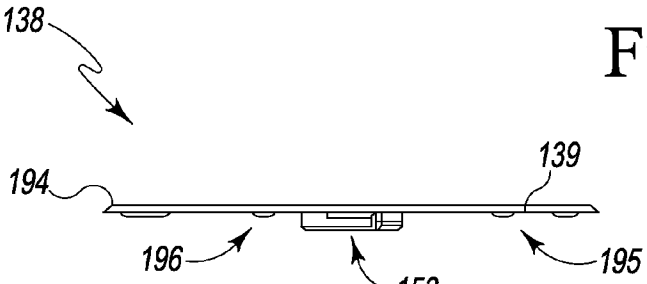
FIG. 41 is a side view of the indexing disk of FIG. 39.

The indexing disk 138 is particularly shown in FIGS. 39-41. The indexing disk 138 has a generally flat, circular body 139 with a central hub 153 and an indexing means 140 defined by a plurality of holes 141, 142, 143, 144, 145, 146 each of a different size. As best seen in FIGS. 40 and 41, the central hub 153 projects axially from the disk 138 and is defined by first and second hub portions 154, 155. The hub portions 154, 155 fit into the central bore 174 of the divider 173 such that the disk 138 is rotatable relative to the divider 173. Rotation of the disk 138 registers one of the holes 141, 142, 143, 144, 145, 146 with the hole 175 of the divider 172 to allow a medicament to pass therethrough.

Referring to FIGS. 42-45, the cap 134 is particularly shown. The cap 134 is defined by a body 135 that is generally cylindrical in shape and defines an upper surface 160 and a lower surface 161. The upper surface 160 may include writing, indicia or the like if desired, or allow labels to adhere thereto. The body 135 has a plurality of vertically disposed gripping ribs 158 on its outside surface. A gripping/thumb area 159 is provided on the side of the annular wall of the body 135. Another gripping/thumb area may be provided on the side of the annular wall of the body 135 diametrically opposite the gripping/thumb area 159. On the inside surface of the annular wall of the body 135 adjacent the gripping/thumb area 159 is a projection 166 that is used to attach the cap 135 to the bottle 132. A projection 164 is also provided on the inside surface 163 of the annular wall of the body 135 adjacent the gripping/thumb area 159 that is likewise used to attach the cap 134 to the bottle 152. The projection 164 is particularly shown in FIG. 45. The projection 164 defines a ledge 165 that snap fits under the upper portion 170 of the bottle 132. The projection 166 has and does likewise.

Figure 43:
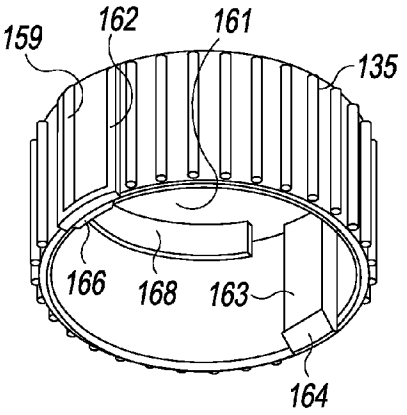
FIG. 43 is an isometric bottom view of the cap of the combination medicine container and dispenser of FIG. 32.
Figure 45:
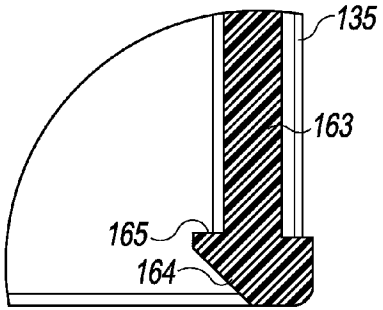
FIG. 45 is an enlarged sectional view of a portion of the cap of FIG. 42.
Figure 42:
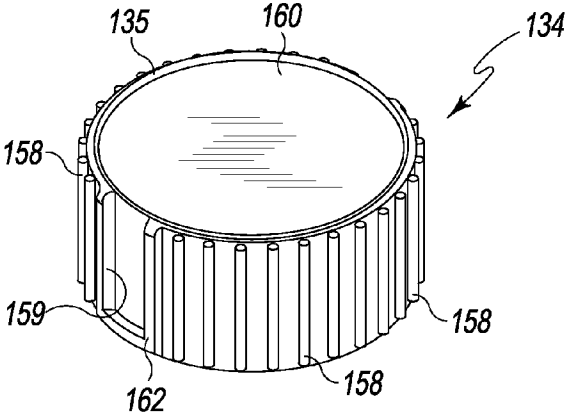
FIG. 42 is an isometric top view of the cap of the combination medicine container and dispenser of FIG. 32.
Figure 44:
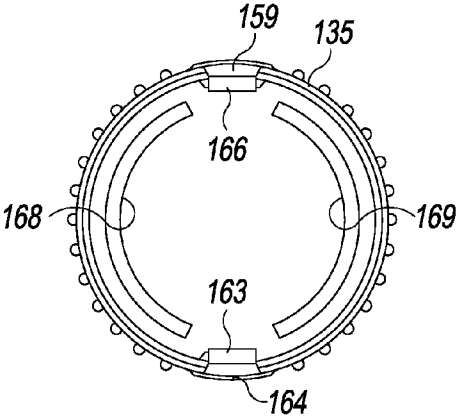
FIG. 44 is a bottom plan view of the cap of FIG. 42.

As best discerned in FIGS. 43 and 44, a first annular wall 168 extends from the bottom 161 of the body 135 and is positioned radially inward of the annular wall of the cap 134. The first annular wall 168 is arch shaped and extends only a portion about the cap 134. A second annular wall 169 extends from the bottom 161 of the body 135 and is positioned radially inward of the annular wall of the cap 134. The second annular wall 169 is arch shaped and extends only a portion about the cap 134. As such, an annular space is defined between the inner walls 168, 169 and the annular wall of the cap 134. In like manner as the embodiment of FIG. 5, the top of the bottle 132 fits into the annular space of the cap 134.

Referring to FIGS. 35-38, the rotary dispenser or nest 136 is shown. The rotary dispenser 136 has a generally cylindrical, knurled base 188 with an enlarged stem 184 extending vertically from the base 188 thereby defining flats 185, 186 on sides thereof. One side of the stem 184 has a channel 190 formed therein which defines an inlet in the top surface of the stem 184 and an outlet in the side of the stem 184. When the rotary nest 136 is rotated, the inlet of the stem 184 can be registered under the hole 175 of the divider 173 and a hole 141, 142, 143, 144, 145, 146 of the indexing disk 138 to receive a single medicament, while the outlet can be registered adjacent the cutout 172 in the bottom of the bottle 152 in order to dispense the single medicament. An indexing means 192 is also provided on the end of the stem 184 opposite the channel 190.

In use, the indexing disk 138 is positioned onto and over the divider 173 such that an appropriate hole 141, 142, 143, 144, 145, 146 of the indexing disk 138 is over the divider hole 175. Thereafter, the bottle 132 is filled with the medicament. The cap 134 is then secured onto the bottle 132. For dispensing a medicament, the rotary nest 136 is rotated to align, index or register the channel 190 with the divider hole 175 and a medicament falls into the channel 190. The rotary nest 136 is rotated such that the channel aligns, indexes or registers with the cutout/outlet 172.

Any and all references cited in this specification are incorporated herein by reference to the extent that they supplement, explain, provide a background for or teach methodology or techniques employed herein.

What is claimed is:

1. A combination medicine container and dispenser comprising:

a cylindrical bottle having, an interior area, a lower cylindrical portion of a first diameter defining a lower interior area of the interior area of the bottle, and having a bottom, an upper cylindrical portion of a second diameter that is greater than the first diameter defining an upper interior area of the interior area of the bottle, and having an open top, the upper interior area in communication with the lower interior area, and a notch in a side of the cylindrical bottle at the bottom of the lower cylindrical portion of the cylindrical bottle in order to provide communication between the lower interior area and outside of the cylindrical bottle, with the upper interior area holding medicaments;

a cap situated on and over the open top of the upper cylindrical portion of the cylindrical bottle; and indexing means disposed in the interior area of the cylindrical bottle and configured to cooperate with the cylindrical bottle to allow a user to dispense a single medicament of the medicaments within the upper interior area through the notch the lower interior area;

the notch in a side of the cylindrical bottle at the bottom of the lower cylindrical portion of the cylindrical bottle providing communication between the lower interior area and outside of the cylindrical bottle;

the cap includes flanges on its underside that cooperate with the cylindrical bottle to retain the cap onto the upper cylindrical portion of the cylindrical bottle; and the indexing means comprises:

a divider situated in the lower interior area of the lower cylindrical portion of the cylindrical bottle defining an upper lower interior area and a lower lower interior area, the divider having a central bore, an offset bore, and posts extending upwardly from the divider, the central bore providing communication between the upper lower interior area of the lower cylindrical portion and the lower lower interior area of the lower cylindrical portion, the offset bore providing a boss;

a disk having a central hub and a plurality of differently sized holes situated radially about the hub, the hub received in the boss of the divider such that disk is rotatable relative to central bore of the divider to register one of the plurality of differently sized holes of the disk with the central bore of the disk to provide communication between the upper lower interior area of the lower cylindrical portion of the cylindrical bottle which holds medicaments and the lower lower interior area of the lower cylindrical portion of the cylindrical bottle; and a dispenser rotatably situated within the lower lower interior area of the lower interior area of the lower cylindrical portion of the cylindrical bottle having a base defining a top with a channel in a side of the base defining an inlet in the top and an outlet at a bottom of the base;

wherein a single medicament of medicaments held in the upper lower interior area of the lower interior area of the lower cylindrical portion and the upper interior area of the upper cylindrical portion of the cylindrical bottle is dispensed from the cylindrical bottle via the outlet at the bottom of the base and through the notch in the side of the cylindrical bottle when the dispenser is rotated from a rotational position wherein the inlet of the channel of the cylindrical base of the dispenser registers with the central bore of the divider and one of the plurality of differently sized holes that is registered with the central bore of the divider such that a single medicament falls into the channel in the side of the base via the inlet of the channel, to a rotational position wherein the outlet of the channel of the base of the dispenser registers with the notch in the side of the cylindrical bottle.

2. The combination medicine container and dispenser of claim 1, wherein the hub of the disk includes a first arcuate projection extending from a side of the disk and about a central axis of the disk, and a second arcuate projection extending from the side of the disk and about the central axis of the disk, the first and second arcuate projections providing rotational positioning of the disk relative to the divider.

3. The combination medicine container and dispenser of claim 2, wherein the hub interacts with the posts to fix a rotational position of the disk relative to the divider.

4. The combination medicine container and dispenser of claim 3, wherein the hub includes indicia for associate medicament size to the plurality of differently sized holes of the disk.

5. The combination medicine container and dispenser of claim 1, wherein the base of the dispenser has a knurled peripheral edge.

6. The combination medicine container and dispenser of claim 1, wherein the flanges of the cap rotatable retain the cap onto the upper cylindrical portion of the cylindrical bottle.

* * * * *